United States Patent [19]

Kotschwar

[11] 4,242,884

[45] Jan. 6, 1981

[54] BEVERAGE COOLER

[76] Inventor: Rex R. Kotschwar, 2311 Lake Ave., Gothenburg, Nebr. 69138

[21] Appl. No.: 36,945

[22] Filed: May 7, 1979

[51] Int. Cl.[3] ..... F25D 3/08

[52] U.S. Cl. ..... 62/371; 62/460; 220/412; 220/466

[58] Field of Search ..... 62/371, 372, 460, 463, 62/457, 60; 220/466, 412

[56] References Cited

U.S. PATENT DOCUMENTS

| | | | |
|---|---|---|---|
| 206,128 | 7/1878 | Phillips | 62/463 x |
| 1,186,418 | 6/1916 | Mischo | 62/457 |
| 1,846,540 | 2/1932 | Brown | 220/412 X |
| 1,847,254 | 3/1932 | Murray | 62/371 |
| 1,988,214 | 1/1935 | Page | 62/453 X |
| 2,624,451 | 1/1953 | Ewing | 220/466 X |
| 2,652,698 | 9/1953 | Schlumbohn | 62/371 X |
| 2,775,872 | 1/1957 | Bell | 62/457 X |
| 3,315,491 | 4/1967 | Zant | 62/338 |
| 3,680,330 | 8/1972 | Canosa | 62/371 X |
| 4,112,706 | 9/1978 | Brister | 62/138 X |

*Primary Examiner*—Albert J. Makay
*Assistant Examiner*—William E. Tapolcai, Jr.
*Attorney, Agent, or Firm*—Henderson & Sturm

[57] ABSTRACT

This invention relates to beverage coolers in general and more specifically to an improved beer keg cooling and transporting device which comprises a segmented foam cooler structure which envelopes the keg and includes a pocket which when filled with a relatively small portion of ice will maintain the keg at a sufficiently cold temperature, and further including handles to facilitate transporting the keg and cooler.

10 Claims, 6 Drawing Figures

BEVERAGE COOLER

BACKGROUND OF THE INVENTION

There are a number of patented beer keg cooler structures as evidenced by U.S. Pat. Nos. 3,614,875; 3,315,491; 3,308,636; and 3,443,397. The prior art devices are either bulky rigid containers with large compartments for ice, or bulky flexible envelope type containers into which a cooling medium, such as ice, is introduced, and wherein the envelope itself is used to transport the kegs for short distances.

A principal problem which has been encountered with the former devices is their bulky size and weight which makes them virtually untransportable once the keg and cooling member are installed. This problem has been compounded by the lack of adequate securing means and gripping elements to facilitate handling. Additionally, the flexible envelope type containers have been vulnerable to puncture, while the rigid containers have been subject to cracking. Moreover, due to the flimsy construction and thinness of the materials employed in some of these prior inventions, the cooling capabilities have been marginal with the cooling medium and keg quickly approaching the ambient temperature.

The instant invention overcomes these various shortcomings of the prior inventions, by providing a sturdy relatively lightweight and compact beer keg cooling container which has been designed to require only a small amount of ice to maintain the enclosed beer keg at a very cold temperature for a long period of time, and which due to its compactness and the provision of sturdy non-abrasive handles, can be transported with relative ease.

SUMMARY OF THE INVENTION

The invention essentially is an insulating container comprised of mating halves which when assembled together securely envelope a beer keg. The container halves are constructed from layered foam with a fiberglass exterior, the foam and fiber-glass materials employed having very good insulating qualities. The container halves once enclosed around a keg are securely held together by straps which encircle the assembly and fasten together. The top surface of the insulating container includes a hole bounded by container walls which together with a concave depression located at the top of the keg form an ice pocket. Once the keg has been tapped through this hole, the pocket is filled with ice. As the ice melts, ice water circulates down the sides of the keg. The movement of the water down the sides of the keg is slowed by an inner layer of open celled sponge type foam provided on the interior of the container halves to completely surround the keg. Once the water reaches the bottom of the keg it escapes through a water permeable seam between the two halves running along the bottom of the keg. This permeable seam prevents the water from collecting at the bottom and thereby reducing the internal temperature of the container. The insulating character of the container being excellent the water retains its low temperature as it flows down the keg. Thus, as long as the ice is replaced as it melts in the ice pocket, a continuous film of ice water continually circulates about the keg and then escapes out of the bottom providing a highly efficient cooling and refrigerating system, utilizing a relatively small portion of ice to maintain a cold keg.

Additionally, sturdy non-abrasive handles are securely attached to the container to facilitate transporting the container with keg installed manually or in a vehicle as desired. Transportability of the container is further facilitated by its relatively compact and lightweight construction.

An object is to provide a cooling container for a beer keg which has excellent insulating characteristics and requires only a small amount of ice to maintain the keg at cold temperatures.

A further object is to provide a keg cooling container which includes a small pocket of ice within which ice melts to form ice water which circulates down the sides of the keg at a slow rate due to a circulation impeding means.

Still another object of this invention is to provide a beer keg cooler which is lightweight, relatively rigid, easy to transport and handle, and which has structural features which minimize and reduce impact forces from an external source.

Still another object of this invention is to provide a beer keg cooler which has superior insulating properties, requires very little additional space beyond that required by a conventional beer keg and employs a sectional construction which is readily manufactured.

A still further object of the present invention is to provide a beer keg cooler which employs the best features of the rigid and flexible coolers in a combined structure.

And still another object of this invention is to provide a beer keg cooler having a novel segmented composite construction, where materials and structural elements cooperate in manner which is new and unique.

These and other objects advantages and novel features of the present invention will become apparent from the following detailed description of the invention when consisted in conjunction with the accompanying drawings.

DESCRIPTION OF THE PREFERRED EMBODIMENT

Figure 1:
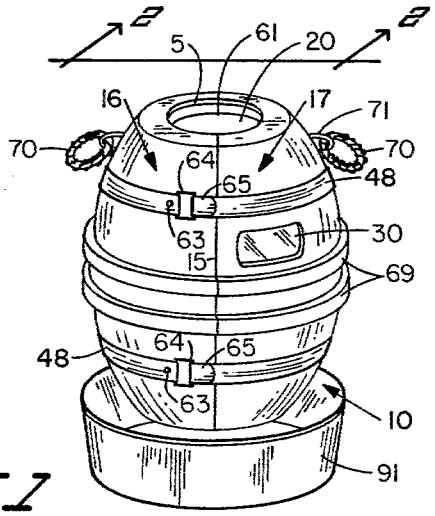
FIG. 1 is a perspective view of the beer keg cooler of the instant invention showing the preferred embodiment.

The beer keg cooler of the instant invention is designated generally as 10 in FIG. 1. The cooler 10 includes two generally arcuate sections 16 and 17 which comprise a container element which surrounds a beer keg 11. Each arcuate section 16 and 17 has a curved side portion 18 which terminates at generally flat end portions 19 and 19'. End portions 19 include semi-circular openings which comprise a hole 20 when the sections 16 and 17 are assembled. See FIG. 1. Hole 20 is bounded by circular wall 5 which is provided with a hard surface. The arcuate sections 16 and 17 comprise hollow half portions which when joined together at a mating seam 15 form an enclosure cavity which is suitably formed to securely envelope a keg 11.

Figure 3:
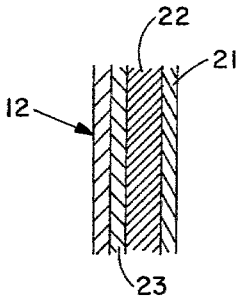
FIG. 3 is a partial cross sectional view of the beer keg cooler taken through lines 3—3 in FIG. 2.

FIG. 3 depicts a cross sectional view through the keg and a typical wall section of one of the arcuate sections 16 and 17 (17 for purposes of this illustration). The arcuate sections 16 and 17 are formed from a multi-layered construction comprising an interior layer 23 of open celled sponge foam material, an intermediate layer 22 of rigid cell foam material, and an exterior layer 21 of polyurethene fiber-glass or similar material.

The interior layer 23 of sponge foam has several functions. Initially, layer 23 protects the intermediate layer 22 of rigid cell foam from any compression denting which might be caused by direct contact with the metal wall 12 of keg 11. Additionally, in that the arcuate sections 16 and 17 are dimensioned such that the keg 11 is in contact with sponge foam layer 23 in the assembled relationship, the keg 11 is held securely in place to prevent rocking. Finally, the sponge foam layer 23 acts as a circulation impeding means to slow the circulation of melted ice water travelling down the sides of the keg, thereby utilizing the refrigeration and cooling capabilities of the ice water to an optimal extent by providing a cooling and refrigerating film of cold water to continually circulate about the keg as will be later described more fully.

The intermediate layer 22 has as its primary purpose insulation and as its secondary purpose the formation of a rigid container within which a beer keg may be transported. The rigid cell foam has thousands of tiny still air pockets which produce an excellent thermal barrier. The rigidty of the rigid cell foam and the thickness 1"–4" employed, produces a lightweight, sturdy thermal container.

The exterior layer 21 also performs dual functions in that it serves as a thermal and vapor barrier as well as providing a decorative exterior which may be appropriately designed for advertising purposes. The polyester employed would be impervious to moisture and the exterior of the container would preferably be of a light color to reflect rather than absorb radiant heat and thereby increase the cooling effectiveness of the container 10. The surface of the polyester exterior layer could be embossed with a company name or have the company's name affixed by other means such as painting, decals, etc. A slightly depressed rectangular plate 30 is provided on the upper exterior surface of section 17 between belt 48 and reinforcing ribs 69 as shown in FIG. 1. Plate 30 is suitable for the affixation of an adhesive decal or other label.

Figure 2:
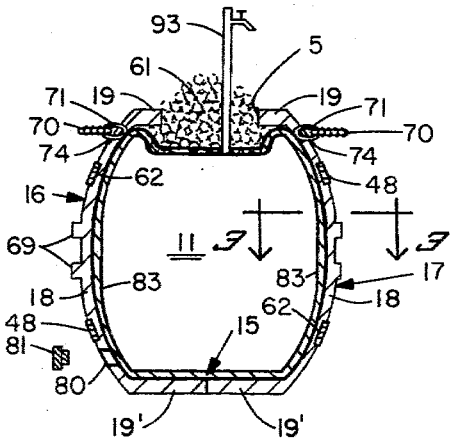
FIG. 2 is a cross sectional elevational view of the beer keg cooler taken through line 2—2 of FIG. 1.
Figure 4:
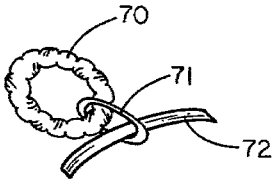
FIG. 4 is a schematic view of the assembled handle and securing elements in perspective.

The arcuate sections 16 and 17 join together at mating seam 15 by means of interfacing butt joints as shown in FIG. 2. The sections 16 and 17 once assembled to envelop a keg are held together by straps 48. The straps 48 have a buckle end 64 and a securing end 65. The straps 48 are secured at buckle end 64 to sections 16 by means of rivets 63. Strap groove 62 encircle the assembled sections 16 and 17 and are of sufficient depth and width to accomodate the straps 48. With sections 16 and 17 joined together with abutting edges, the straps 48 are received within strap grooves 62 to encircle the sections 16 and 17 so that securing ends 65 can be inserted through buckle end 64, and pulled in the reverse direction to tighten the straps 48 and thereby securely hold sections 16 and 17 in the assembled relationship. Securing ends 64 are provided with velcro tape securing means as are mating portions of straps 48. These velcro tape fastening surfaces permit the straps once cinched tightly around the sections 16 and 17 to be securely fastened. Note that the buckle end 64 are riveted within the strap grooves 62 to facilitate the cinching up of the straps 48 by preventing them from sliding around the container 10. Incidentally, these rivets 63 also ensure that the straps 48 will not be lost. Note also that strap grooves 62 prevent the straps 48 from vertical slippage once they have been securely fastened around the assembled sections 16 and 17. The arcuate sections 16 and 17 also include reinforcing ridges 69 which encircle the assembled sections 16 and 17 and strengthen the container 10. Also provided on arcuate sections 16 and 17 are handles 70. Handles 70 are interlooped with loop elements 71 as shown in FIGS. 1, 2 and 4. Metal straps 72 are inserted through loops 71 as shown schematically in FIG. 4. The metal straps 72 lie within accomodating grooves (not shown) formed in the interior surface of the intermediate layer 22 of the walls of the arcuate sections 16 and 17. Layers of epoxy or some other suitable material are then laminated over the metal straps 72 so that they are imbedded within the walls. The loop elements 71 thus attached through one end to the embedded strap 72 extends through loop slot 74 formed in the wall of sections 16 and 17 so that a portion of the loop 71 extend outside the container 10. Handles 70 are interlooped with these exteriorly extending portions of loops 71 and would preferably be comprised of a non-abrasive material such as a heavyweight decorative nylon rope. The loop slots 74 have inside surfaces which have been coated with a hard material to withstand any rubbing action by the loop elements 71. The handles 70 are thus securely fastened to the arcuate sections 16 and 17 and permit transporting of the container manually. The container 10 can optionally be provided with a side tap hole 80 for those kegs which are of the side tapper design. A plug 81 could be provided to seal the hole 80 when it is not required. The plug 81 could also be removed to drain ice water which circulates to the bottom of the container.

In operation, the keg cooling container of the instant invention would be used as follows. The arcuate sections 16 and 17 would be assembled over a keg 11. Straps 48 would be aligned in the strap groove 62 to encircle the sections 16 and 17 with the fastening end 65 being inserted through the buckle end 64 and then cinched back in the reverse direction to tighten the straps 48 around the assembled sections 16 and 17. The rivets 63 would prevent the straps 48 from slipping around the container as they are being tightened. Once the straps 48 were suitably tight, the securing ends 65 would be secured by means of mating velcro tape closures. With the keg thus secured within the enclosure cavity of the container 10, a tapping rod 80 would be inserted into the circular opening 20 at the top of the keg. The ice would then be loaded into the hole 20 and would fill an interior chamber or ice pocket 61 created by the concave depression in the top of the keg 11 and the walls 5 surrounding the hole 20 as shown in FIG. 2. As the ice melts, ice water would circulate down the sides of the keg. The flow of this ice water would be slowed by the open celled sponge foam layer 23 which surrounds the keg. When the ice water reaches the bottom of the keg it would be permitted to escape out the seam 15 between the bottom portions 19' of the assembled section 16 and 17. This water permeable seam would prevent the water from being trapped at the bottom of the keg and eventually rising up the walls of the keg. Such a water build up, it is believed, would reduce the inside temperature of the container and its cooling effectiveness. With the ice water thus slowly circulating down the sides of the keg as impeded by the foam layer 23, and escaping out of the bottom of the container 10, a film of very cold ice water is provided to envelope and continually circulate about the keg comprising a very effective cooling and refrigerating system. The temperature of the water is maintained by the insulating foam layers of the walls of the sections 16 and 17. Hence, as long as the ice is replaced as it melts in the ice pocket, a film of very cold water will continually circulate about the keg and maintain the beer contained within at a suitably cold temperature. Moreover, the entire assembly is relatively lightweight and compact to facilitate transporting manually or by vehicle as desired. Optionally, as shown in FIG. 1, a shallow ice melt pan 91 can be provided to collect the ice water as it escapes through the bottom seam 15 of the container 10.

The operation of the container 10 would be essentially the same for a side tap keg. The only difference being that as the keg is assembled into the sections 16 and 17, the side tap opening (not shown) in the keg 11 would have to aligned with the side tap hole 80 of the section 16. With that alignment made, the straps 48 would be secured to hold the keg in place in the container. The said side tap rod would then be inserted and ice loaded into the ice pocket. Again, as the ice melts, ice water would slowly travel down the sides of the keg with more ice being added on top to refill the ice pocket.

As an alternative embodiment of a means to slow the circulation of the ice water down the sides of the keg, instead of the continuous layer 23 of open celled sponge foam being provided on the inside of the section walls, two strips of foam could be provided to encircle the keg one just above and one just below the reinforcing ridges 69. These strips of foam (not shown) would thereby selectively impede the flow of ice water just above and just below the central vertical side portion 83 of the keg 11 where the water would be likely to travel the fastest. The rate of flow of the ice water down the sides of the keg 11 would thereby be equalized and substantially uniform.

Figure 5:
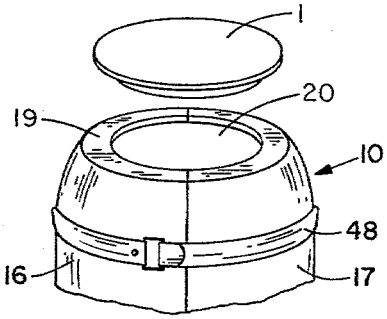
FIG. 5 is a partial perspective view of a modified version of the beer keg cooler showing an optional lid.
Figure 6:
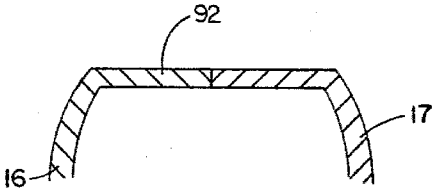
FIG. 6 is a partial cross sectional view of the modified beer keg cooler showing a solid top portion with no hole.

The keg cooling container could also be modified for bulk transportation use obviating the need for refrigerator trailer trucks. As shown in FIG. 5, a cap 1 could be provided to seal the circular opening 20 in the top portion 19 of the container 10. Or alternatively, as shown in FIG. 6, a special bulk transportation keg cooling container 91 could be manufactured which has a solid flat top 92, with no hole. In either case, the beer kegs would be prechilled prior to transport, inserted into the cooling containers and loaded onto a truck for delivery. Due to the insulating characteristics of the cooler, the kegs would arrive at their destination at approximately the same temperature they were at their point of departure. Should several destinations be planned for the total contents of the truck, the individual coolers will maintain the temperature of their respective kegs while a portion of the cargo is unloaded.

Having therefore fully disclosed the subject matter of this invention, it should be obvious that many modifications, substitutions and variations of the present invention are possible in light of the above teachings. In particular, it is understood that the configuration of the keg cooling container dislosed in the drawings is merely for illustration, and that the container can easily be modified to accomodate a beer keg of any size or shape. It is therefore to be understood that within the scope of the appended claims, the invention may be practiced other than as specifically described herein.

I claim:

1. An improved beverage cooler in the form of an insulating container, comprising:

a container element having insulating characteristics;

an enclosure cavity within said container element to envelope a beverage container;

an interior chamber within said container element for receiving a cooling medium such as ice;

a means for opening said container element to install said beverage container into said enclosure cavity; and a means for securing said container element so that said beverage container is securely held within said enclosure cavity;

said beverage container having an exterior surface and said interior chamber being provided within said container element above said enclosure cavity so that when said beverage container is installed in said enclosure cavity, and an amount of ice is received within said interior chamber, said ice will melt and transform into an amount of ice water, said ice water circulating by the force of gravity down said exterior surface of said beverage container;

said container element having an interior surface and said interior surface being provided with a circulation impeding means for impeding the circulation of said ice water down said exterior surface of said beverage container;

said interior surface of said container element having a bottom portion, said container element further comprising a means for allowing said ice water to escape said container element once said ice water has circulated down said exterior surface of said beverage container to said bottom portion of said interior surface of said container element.

2. The improved beverage cooler of claim 1 further comprising handle element secured to said container elements for manually transporting said container element with said beverage container and said ice cubes installed therein.

3. The improved beverage cooler of claim 2 wherein said container element comprises two complimentary arcuate sections adapted to be joined together to form said enclosure cavity, each of said arcuate sections having a curved side portion, a top portion, and a flat bottom portion, said arcuate sections when joined together forming a mating seam, said mating seam having a bottom portion running between said flat bottom portions of said arcuate sections, said mating seam bottom portion being water permeable and comprising said escape means, said arcuate sections also comprising said opening means.

4. The improved beverage cooler of claim 3 wherein each of said arcuate sections comprises an inner layer of open celled porous sponge material, an intermediate layer of rigid cell foam having a multitude of minute still air pockets, and an outer layer of water impervious material.

5. The improved beverage cooler of claim 4 wherein said securing means comprises a pair of flexible strap members which encircle said arcuate members when said arcuate members are joined together in a joined relationship to enclose said beverage containers, said strap members including a means for tightly sewing said arcuate members in said joined relationship.

6. The improved beverage cooler of claim 5 wherein said beverage container is a beer keg, and said enclosure cavity snugly envelopes said beer keg when said arcuate sections are in said joined relationship.

7. The improved beverage cooler of claim 6 wherein said interior chamber has a bottom portion and an upper side wall portion, said beer keg having a concave top portion which comprises said bottom portion of said interior chamber, and said top portion of said container element including a hole bounded by said upper side wall portion of said interior chamber.

8. The improved beverage cooler of claim 7 wherein said container element has an exterior surface and includes a label plate which is substantially rectangular and slightly depressed into said exterior surface.

9. The improved beverage cooler of claim 8 further comprising a lid element which is installed in said top of said container element to seal said hole.

10. The improved beverage cooler of claim 9 further comprising a side tap hole formed in said container element to permit a tapping rod to be installed in a side tap keg enclosed in said container element.

* * * * *